US006866096B2

(12) United States Patent
Tillett, Jr.

(10) Patent No.: US 6,866,096 B2
(45) Date of Patent: Mar. 15, 2005

(54) E-LINE DOWNHOLE JARRING TOOL

(75) Inventor: Ray O. Tillett, Jr., Houma, LA (US)

(73) Assignee: Impact Selector, Inc., Rockwall, TX (US)

( * ) Notice: Subject to any disclaimer, the term of this patent is extended or adjusted under 35 U.S.C. 154(b) by 165 days.

(21) Appl. No.: 10/401,444

(22) Filed: Mar. 27, 2003

(65) Prior Publication Data

US 2004/0188084 A1 Sep. 30, 2004

(51) Int. Cl.[7] ..... E21B 31/107
(52) U.S. Cl. ..... 166/178; 175/306; 173/90
(58) Field of Search ..... 166/301, 178; 175/414, 293, 306; 173/90, 112

(56) References Cited

U.S. PATENT DOCUMENTS 2,203,595 A * 6/1940 Hall et al. ..... 166/116
2,241,477 A * 5/1941 Rasmussen ..... 175/302
3,406,770 A * 10/1968 Arterbury et al. ..... 175/299
4,376,468 A * 3/1983 Clark ..... 175/304
4,736,797 A * 4/1988 Restarick et al. ..... 166/301
5,069,282 A * 12/1991 Taylor ..... 166/301
6,290,004 B1 * 9/2001 Evans ..... 175/296
6,481,495 B1 * 11/2002 Evans ..... 166/65.1

* cited by examiner

*Primary Examiner*—David Bagnell
*Assistant Examiner*—Daniel P Stephenson
(74) *Attorney, Agent, or Firm*—Haynes and Boone, LLP

(57) ABSTRACT

According to the present invention, the e-line downhole jarring tool is an electrical line downhole tool for manipulating a work string which is easily configured to deliver a specific amount of force to the work string in a small and simple apparatus.

2 Claims, 2 Drawing Sheets

E-LINE DOWNHOLE JARRING TOOL

BACKGROUND OF THE INVENTION

The present invention relates to downhole fishing and drilling operations, or removing obstructions to a drilling line when such a line becomes lodged or otherwise stuck in a well bore. Consequences of failure to remove the obstruction can be failure of the well to produce at all or in part, also, current methods of removing obstructions can result in failure to loosen the work string, both of which result in having to relocate the drilling operation, which necessarily involves lost time and money.

This problem can be overcome, as it is now, by various devices which exert pressure or mechanical energy on the work string in an attempt to dislodge it. These tools are generally large, complex and expensive, and many are not easily configured to apply varying amounts of force to the work string, which can result in imprecise application of energy to the work string. This, in turn, can break or otherwise damage the work string, resulting in a requisite move of a project, or at the very least, lost time and energy in repairing the work string.

The current invention fills the existing gap in technology by providing a relatively small, simple, adjustable tool which can be easily transported and implemented and be tailored to specific applications.

Additionally, the current invention permits an electric or other line to be run through the center of the tool, which can be used to convey electricity or data from one end of the work string to the other.

It is known in the art to apply force to dislodge a work string, however the current devices in this field do not offer the unique combination of the small, simple and configurable characteristics inherent in the configuration presented herein.

OBJECTS OF THE INVENTION

One object of the invention is to provide a downhole tool capable of dislodging a work string.

Another object of this invention is to provide a configurable device which can apply specific amounts of pressure to a work string.

Still another object of the invention is to provide a device which can accommodate an electrical, data or other line through the tool to permit current or data to be conveyed from one end of the tool to the other.

Still another object of the invention is to provide a device that is small and easily transported.

Other objects and advantages of this invention shall become apparent from the ensuing descriptions of the invention.

SUMMARY OF THE INVENTION

According to the present invention, the invention is an electrical line downhole tool for manipulating a work string which is easily configured to deliver a specific amount of force to the work string in a small and simple apparatus.

BRIEF DESCRIPTION OF THE DRAWINGS

The accompanying drawings illustrate an embodiment of this invention. However, it is to be understood that this embodiment is intended to be neither exhaustive, nor limiting of the invention. They are but examples of some of the forms in which the invention may be practiced.

DETAILED DESCRIPTION OF EXEMPLARY EMBODIMENTS

Figure 1A:
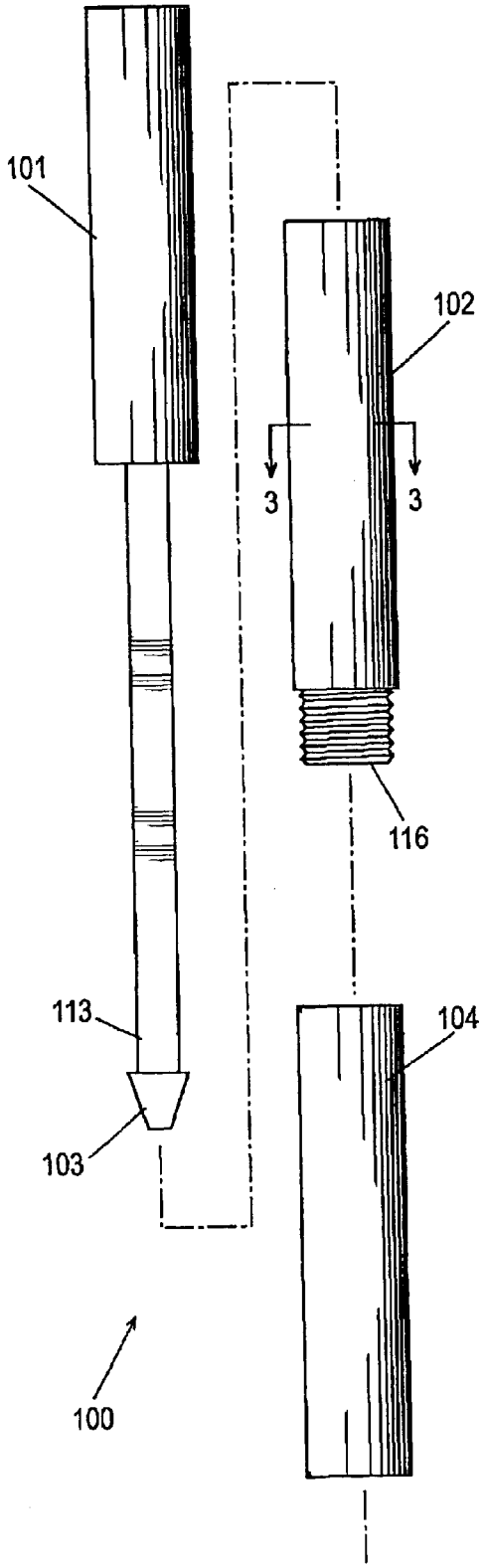
FIG. 1A shows a side view of the top half of the jarring tool, partially disassembled.
Figure 1B:
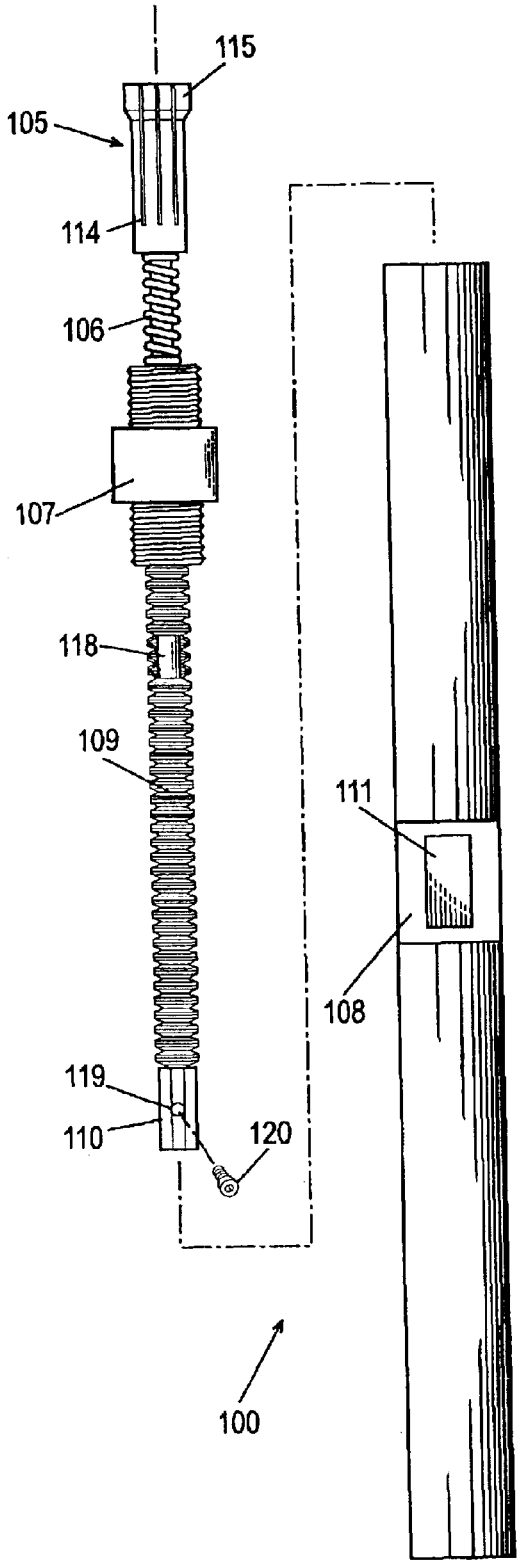
FIG. 1B shows a side view of the bottom half of the jarring tool, partially disassembled.
Figure 2A:
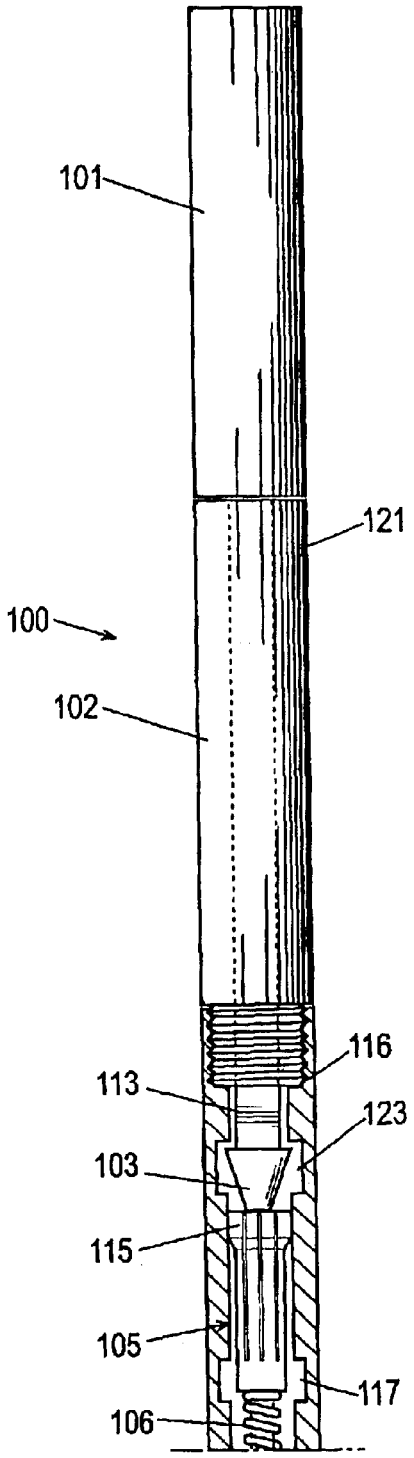
FIG. 2A shows a cutaway view of the top half of the jarring tool.
Figure 3:
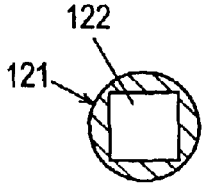
FIG. 3 shows a top view of the aligning collar.
Figure 2B:
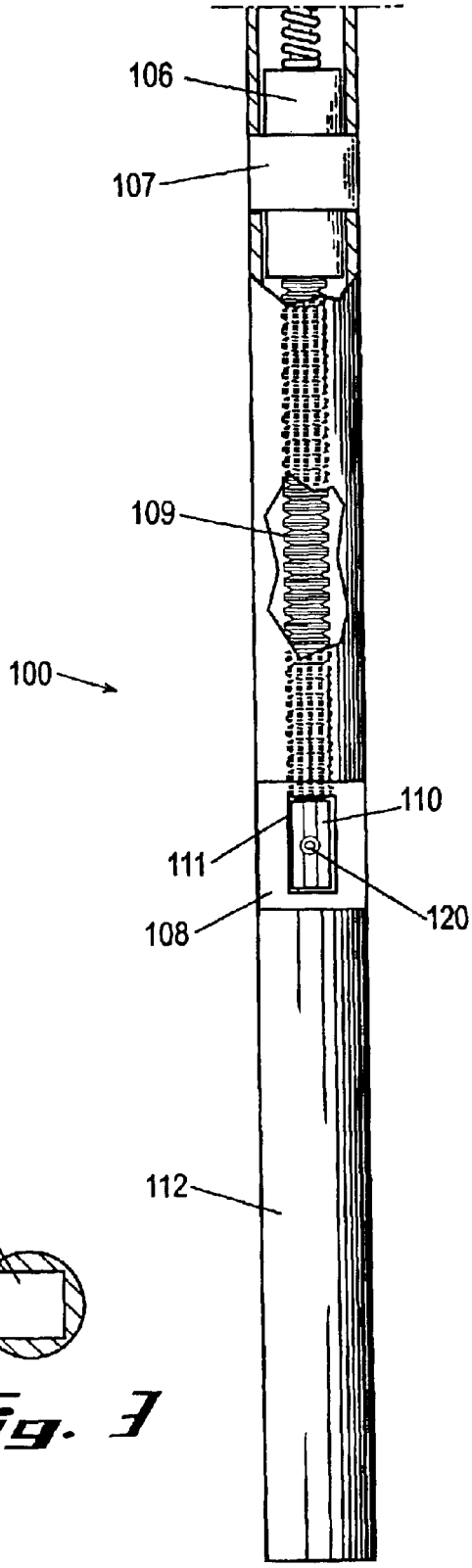
FIG. 2B shows a cutaway view of the bottom half of the jarring tool.

Without any intent to limit the scope of this invention, reference is made to the figures in describing the various embodiments of the invention. Referring to FIGS. 1 through 3, line downhole jarring tool 100 is pictured.

Jarring tool 100 has a hammer mandrel 101 near the top end of jarring tool 100 which is formed with shaft 113 extending from the bottom end of hammer mandrel 101. Shaft 113 can be formed such that a portion of shaft 113 has beveled sides, providing a flat surface that permits the shaft to be turned with a wrench, as well as forming a "keyed" relationship with the square opening 122 of retaining mandrel 102's aligning collar 121. This "keyed" relationship prevents relational touring between shaft 113 and retaining mandrel 102. This arrangement also precludes the need for aligning screws or other components, which detract from the simplicity and effectiveness of a tool.

At the end of shaft 113, shaft 113 forms a releasable bolt 103 which can be shaped conically as pictured, but could conceivably take various shapes, so long as releasable bolt 103 could be grasped and retained by another device, as explained in further detail below. The conical or "spear" shape of releasable bolt 103 also facilitates the re-entry of releasable bolt 103 into collet 105, explained in greater detail below.

Retaining mandrel 102 surrounds shaft 113, and is usually threaded at one end to receive firing mandrel 104 which lies below it on jarring tool 100. Firing mandrel 104 is generally cylindrical in shape, and having unlatching recess 117 along firing mandrel's 104 inner diameter, which is shaped to accommodate collet 105 as outlined below. Releasable bolt 103 also prevents shaft 113 from disengaging retaining mandrel 102 by virtue of releasable bolt's 103 size being larger than that of the edge 116 of retaining mandrel 102.

Collet 105 is attached to a kinetic energy shaft 118 toward the top end of jarring tool 100. Collet 105 can have longitudinal slits 114 around its body, such that the overall diameter of collet 105 can be permitted to increase by radially expanding or separating slits 114. The top end 115 of collet 105 should also be configured to be of larger diameter than the remainder of collet 105 to create a section that can enter either latching recess 117 or unlatching recess 123 of firing mandrel 104 permitting collet 105 to expand. This will be explained in greater detail below.

Positioned between collet 105 and middle joint 107 is reloading mechanism 106, generally a spring or spring-type device, which is held in place between collet 105 and middle joint 107. It is positioned such that pressure is exerted upwardly on collet 105 and downwardly on middle joint 107.

Kinetic energy store 109 is positioned around kinetic energy shaft 118, and can be any mechanical kinetic energy store, like a Belleville washer stack or a spring. Kinetic energy store 109 is usually a Belleville washer stack, which is generally an assemblage of concave washers stacked end to end such that resistance and linear energy is built up when the kinetic energy store 109 is compressed.

At the base of kinetic energy shaft 118 is threaded or otherwise attached adjuster collar 110. This is configured such that as adjuster collar 110 is threaded onto the bottom end of kinetic energy shaft 118, such that as adjuster collar 110 is turned up the tool, compression is naturally increased on the kinetic energy store 109, and thus upward resistance is increased.

There is also in some exemplary forms of the invention threaded hole 119 drilled in kinetic energy shaft 118, generally perpendicular to the lateral axis of jarring tool 100. This provides for setscrew 120 which, when engaged in threaded hole 119, prevents adjuster collar 110 from turning about its axis.

Surrounding and encasing kinetic energy shaft 118 and kinetic energy store 109 is bottom mandrel 112. Integrated in bottom mandrel 112 is adjuster collar guard 108. Collar guard 108 has opening 111 which is essentially a window used to access adjuster collar 110. Collar guard 108 is able to be turned about the axis of the tool, such that opening 111 only reveals a small portion of the surface beneath it. When properly actuated, however, opening 111 of collar guard 108 reveals adjuster collar 110 so that it may be accessed, and thus adjusted via various means. If collar guard 108 is then turned further, it effectively conceals adjuster collar 108, thus preventing contaminants from entering, or from accidental adjustment of the components.

Joining bottom mandrel 112 to firing mandrel 104 is middle joint 107, which also houses a portion of kinetic energy shaft 118.

Each of the parts which lie along the central axis, if they are to be used in an application which requires electrical, data or other connections at the base of the tool can have a bore drilled parallel to this axis to permit runs of electrical or other wire through the center of jarring tool 100. In such an application, parts along the center portion of the tool, such as shaft 113, releasable bolt 103, hammer mandrel 101, collet 105 and kinetic energy shaft 118 have a bore in the center of them, permitting a wire or other ductile compound to be threaded through them, and thus, the entire tool.

In operation, line downhole jarring tool 100 will be attached on its top and bottom ends to the work string. Jarring tool 100 will be likely initially "set," whereby releasable bolt 103 is inserted into the center of collet 105. This "setting" procedure is accomplished by moving shaft 113, and thus bolt 103, toward the bottom end of jarring tool 100. Bolt will press against collet 105, pushing it down whereby the top 115 of collet 105 will enter latching recess 117, and bolt 103 will enter collet 105. In this way, bolt 103 becomes mechanically coupled with collet 105, and is ready for the impact stroke of jarring tool 100.

Adjuster collar guard 108 will be rotated about the axis of jarring tool 100 so that opening 111 will permit access to setscrew 120, such that setscrew 120 may be removed, in turn permitting adjuster collar 110 to be threaded up or down, providing a corresponding increase or decrease in the tension stored in kinetic energy store 109. In an exemplary embodiment, each full turn of adjuster collar 110 will raise or lower the pressure stored in kinetic energy store 109 by one hundred (100) pounds. Setscrew 120 can then be replaced, effectively locking adjuster collar 110 in place. Adjuster collar guard 108 can then be rotated back around to re-conceal setscrew 120 and related parts of adjuster collar 110. Naturally, the setting need not be one hundred pounds, but is helpful to the operator to be in whole number increments, as to provide easy administration of pressure changes.

When an obstruction is encountered, or the drill string otherwise needs to be loosened, force will be applied to jarring tool 100, drawing back on the end of jarring tool 100. When this force is applied to hammer mandrel 101, shaft 113 is also drawn upward by virtue of its mechanical connection to hammer mandrel 101. Releasable bolt 103 will similarly be drawn back, and move with it collet 105 and thus kinetic energy shaft 118.

As the force is applied, kinetic energy will continue to build as a result of the compression of kinetic energy store 109 under the force applied to hammer mandrel 101. As this force increases, hammer mandrel 101, shaft 113, releasable bolt 103, collet 105, and kinetic energy shaft 118 all move toward the top end of jarring tool 100 until collet's 105 top end 115 slides into unlatching recess 117, at which point longitudinal slits 114 expand, and releasable bolt 103 is released.

As a result of this, the full store of kinetic energy in kinetic energy store 109 is exerted up and away, such that releasable bolt 103 travels quickly up within retaining mandrel 102 until it strikes edge 116 of retaining mandrel 102, delivering the upward stroke, which, by design, helps to loosen the work string.

At this time, the previous force exerted upon tool should be reversed, mechanically or otherwise, such that releasable bolt 103 will be inserted back into collet 105. As bolt 103 is inserted into collet 105, collet 105 is pushed back beyond unlatching recess 117 such that slits 114 are compressed, once again holding and retaining releasable bolt 103 within the confines of collet 105. This cycle is thus repeated to achieve the desired hammering effect to loosen or otherwise manipulate the work string.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

The invention claimed is:

1. A line downhole jarring tool having a top end and a bottom end comprising a:

a. hammer mandrel having a top portion and a bottom portion, disposed near said top end of said jarring tool comprising a:
   i. hammer portion disposed toward said top portion of said hammer mandrel;
   ii. releasable bolt disposed toward said bottom portion of said hammer mandrel; and
   iii. shaft disposed between said top portion and said releasable bolt of said hammer mandrel;

b. retaining mandrel shaped to envelop a substantial portion of said shaft;

c. said retaining mandrel having an aligning collar positioned toward said top end of said jarring tool configured to engage said shaft such that said shaft cannot be significantly rotated relative to said retaining mandrel;

d. collet having a first end and a second end, said second end disposed toward said bottom end of said jarring tool having a predetermined diameter, and said first end disposed toward said top end of said jarring tool and having a larger diameter than that of said second end, and said collet having longitudinal slits along substantially the entire length of said collet, configured to permit radial expansion, and shaped to operatively engage said releasable bolt;

e. firing mandrel having a first section and a second section, wherein said first section is disposed toward said bottom end of said jarring tool and having an inner diameter shaped to receive said collet, wherein said second section is shaped to operatively receive said retaining mandrel and disposed toward said top end of said jarring tool having an inner diameter larger than that of said first section forming a cavity, such that said second section permits the release of said releasable bolt by accommodating said collet when said collet radially expands in said cavity;

f. reloading mechanism disposed between the collet and said middle joint configured to urge said collet toward said top of said jarring tool;

g. kinetic energy shaft having first and second opposite ends, said first opposite end disposed toward top end of said jarring tool, wherein said collet is attached to said first opposite end;

h. kinetic energy srore configured to operatively engage a substantial portion of said kinetic energy shaft;

i. a bottom mandrel shaped to house said kinetic energy shaft;

j. adjuster collar attached to said second opposite end of said kinetic energy shaft and configured to move up and down said kinetic energy shaft;

k. collar guard operatively attached to said bottom mandrel and configured to accommodate said adjuster collar and shaped to have an opening configured to permit access to said adjuster collar when said collar guard is rotated about the axis of said kinetic energy shaft; and l. middle joint having first end and second end and shaped to operatively engage said firing mandrel on said first end and shaped to operatively receive said bottom mandrel on said second end.

2. A line downhole jarring tool according to claim 1 having a bore running through the center of said shaft, said releasable bolt, said hammer mandrel, said collet and said kinetic energy shaft, forming a cavity shaped to operatively receive at least one wire.

* * * * *